United States Patent [19]

Zaltsman

[11] 4,435,942

[45] Mar. 13, 1984

[54] METHOD AND APPARATUS FOR STOPPERING MODIFIED BOTTLES WITH A ONE-PIECE CORKING MEANS

[75] Inventor: Efim Zaltsman, Brooklyn, N.Y.

[73] Assignee: Monarch Wine Co., Inc., Brooklyn, N.Y.

[21] Appl. No.: 368,990

[22] Filed: Apr. 16, 1982

Related U.S. Application Data

[62] Division of Ser. No. 223,894, Jan. 9, 1981, abandoned.

[51] Int. Cl.[3] ..... B67B 1/04; B67B 3/22; B65B 7/28

[52] U.S. Cl. ..... 53/489; 53/485

[58] Field of Search ..... 53/410, 489, 487, 485, 53/359, 412, 334, 328, 319, 324; 220/375; 215/321, 306, 308

[56] References Cited

U.S. PATENT DOCUMENTS

| | | | |
|---|---|---|---|
| 2,814,404 | 11/1957 | Towns | 215/308 |
| 2,961,119 | 11/1960 | Leach . | |
| 3,145,872 | 8/1964 | Hayes | 220/375 X |
| 3,199,707 | 8/1965 | Folkman . | |
| 3,235,117 | 2/1966 | Mason, Jr. | 215/321 X |
| 3,407,956 | 10/1968 | Linkletter et al. | 215/306 |
| 3,473,685 | 10/1969 | Karlan . | |
| 3,645,062 | 2/1972 | Hannon | 53/334 X |
| 3,691,725 | 9/1972 | Cassimatis et al. | 53/328 |
| 3,851,783 | 12/1974 | Braginetz | 15/306 X |
| 3,994,409 | 11/1976 | Nightengale, Jr. | 215/306 X |

*Primary Examiner*—Horace M. Culver

[57] ABSTRACT

A closure arrangement for stoppering bottles with pressurized, carbonated, water-based liquid contents which comprises in combination; a bottle having a body portion, an elongated neck portion with two annular flanges thereon, and a mouth portion; and a one-piece elastomeric plastic molded corking means having an elongated cylindrical stopper insertable into the mouth of the bottle, a head connected to the stopper, an annular, circumferential ring positioned below the head, concentric with the stopper and capable of being received between the two annular flanges, a flexible, elongated folded tether connecting the ring to the head, and a plurality of short frangible bridges connecting the ring to the head, said bridges breaking when the ring is forced between the two flanges. The elongated tether provides a means for preventing injury when the cork is removed from the bottle.

2 Claims, 9 Drawing Figures

FIG. 1
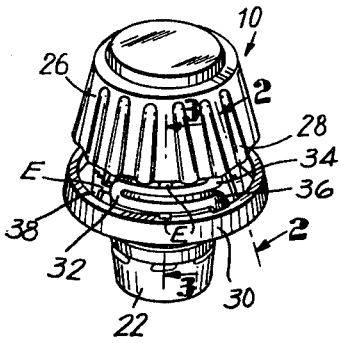
FIG. 2
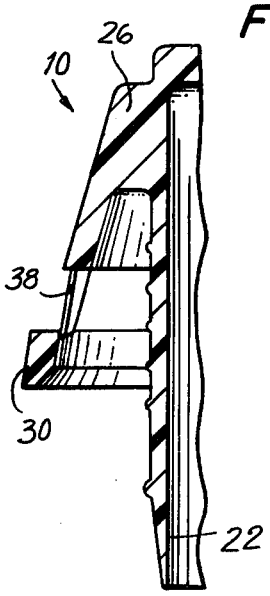
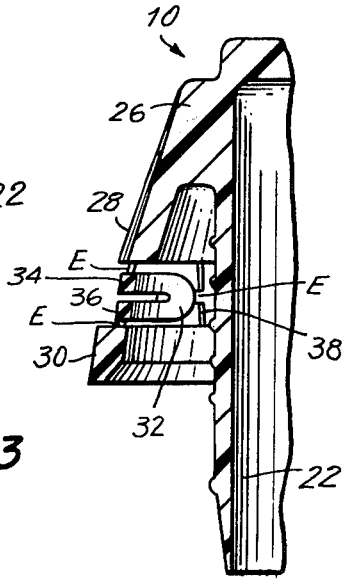
FIG. 3
FIG. 4
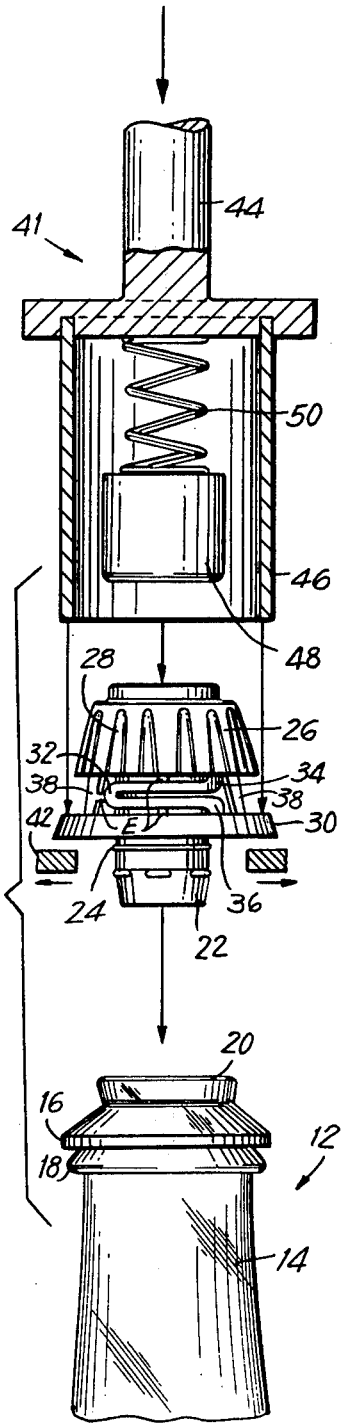

FIG. 5
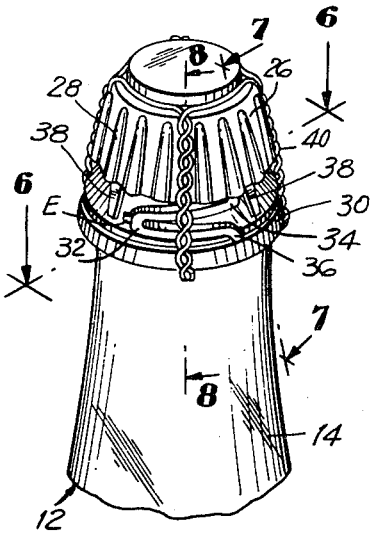
FIG. 6
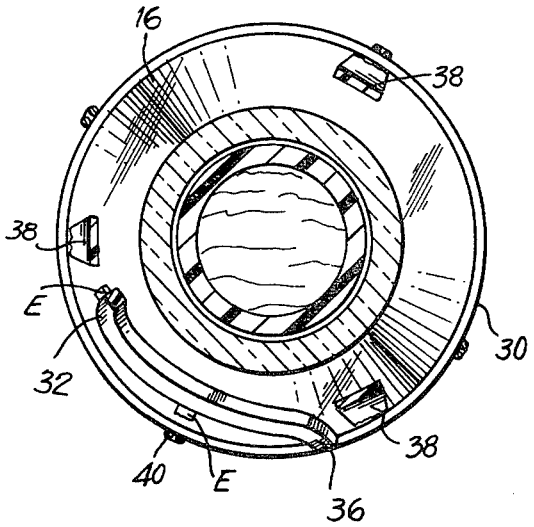
FIG. 7
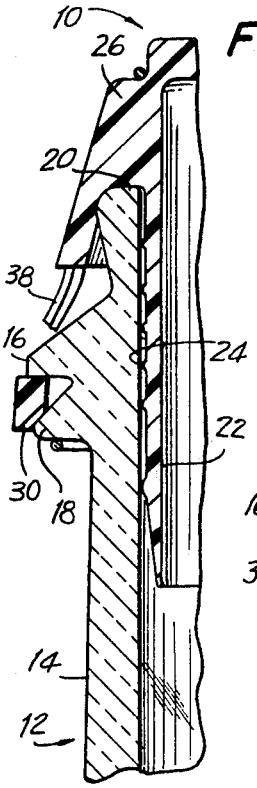
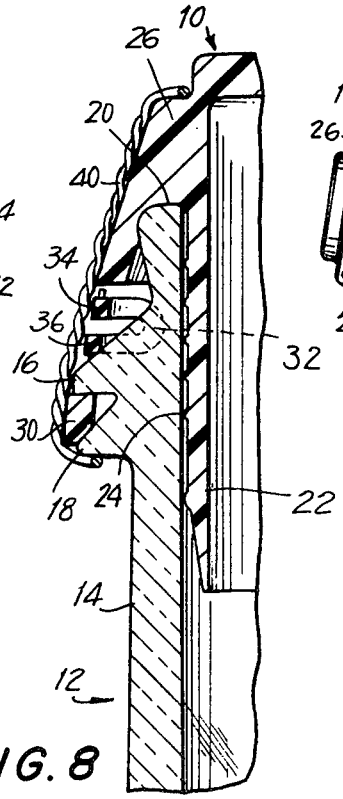
FIG. 8
FIG. 9
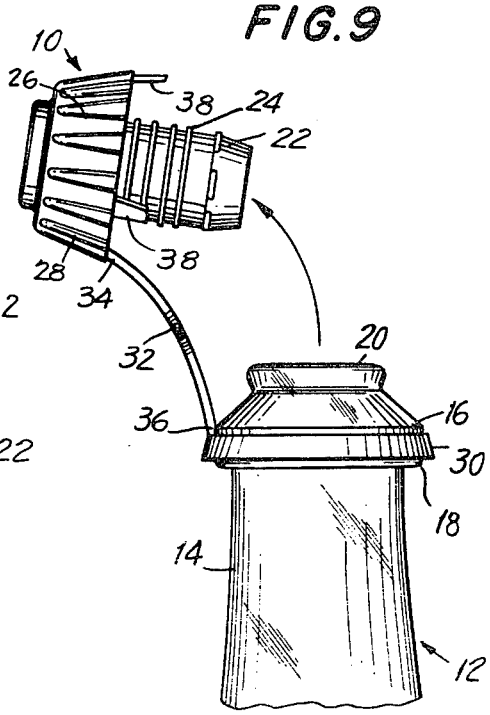

METHOD AND APPARATUS FOR STOPPERING MODIFIED BOTTLES WITH A ONE-PIECE CORKING MEANS

This is a division of application Ser. No. 223,894, filed Jan. 9, 1981 now abandoned for Method and Apparatus for Stoppering Modified Bottles with a One-piece corking means.

BACKGROUND OF THE INVENTION

1. Field of the Invention

The present invention generally relates to stoppering bottles with pressurized, carbonated, water-based liquid contents and, more particularly, to a plastic one-piece corking means for stoppering bottles with elongated necks having two annular flanges on said neck close to the mouth.

2. Description of the Prior Art

It long has been recognized that bottles with pressurized, carbonated contents present a hazard. When these bottles are opened by a user, oftentimes the cork will be ejected from the bottle with a degree of force capable of causing injury to people. Facial and eye injuries have been known to occur when a cork is propelled out of a bottle with considerable force.

A number of different closure arrangements for bottles with pressurized, carbonated contents have been utilized in the prior art. US Letters Pat. No. 3,986,627 describes a stoppering system for bottles and discloses a cap portion which is attached to a securing ring on the bottle through a flexible bridging member. The cap portion is not inserted into the neck of the bottle. U.S. Letters Pat. No. 4,054,221 also discloses a capping device in which the cap is attached to a ring on the bottle by a strap portion. This patent, as did the foregoing, discloses a stoppering device that is not inserted into the neck of the bottle. U.S. Letters Pat. No. 773,345 discloses a multi-part stoppering system in which the cork portion is attached to a loop around the bottle neck via a chain or wire.

U.S. Letters Pat. No. 1,265,263 discloses a stoppering system in which a cork portion is secured to a bottle via a rope or wire loope system. This is a multi-part device.

British Pat No. 15267 discloses a multi-part corking device in which the cork is secured to the bottle via a chain. West German Pat. No. 2,200,857 also discloses a multi-part corking device in which the cork portion is secured to the bottle neck via a tether. Swiss Pat. No. 338,108 discloses a bottle stoppering system in which a cap portion is secured to a bottle via a tether. This stoppering system utilizes a capping, and not a corking device. The tether extends horizontally outward of the outer surface of the bottle. The corking device is of a one-piece plastic construction.

Although all of these closure arrangements appear to be satisfactory for their intended purposes, they have drawbacks for use in stoppering bottles with pressurized, carbonated, water-based liquid contents. Due to the existence of an outwardly extending tether on some of the prior art arrangements, wiring of the bottles after cooking is difficult. It is also difficult to pack large numbers of stoppered bottles.

In the prior art arrangements that have multi-part corking portions, problems arise in assembly and inventory which add to the total cost of stoppering the bottles.

SUMMARY OF THE INVENTION

1. Purposes of the Invention

It is an object of the present invention to provide a closure arrangement for stoppering of bottles with pressurized, carbonated, water-based liquid contents which is not subject to the drawbacks of the prior art closures.

It is another object of this invention to provide a safe system for stoppering the afore-described bottles.

It is yet another object of this invention to provide a closure arrangement of the character described which consists of few parts and is easy to assemble.

Still another object of this invention is to provide an inexpensive closure arrangement of the character described.

Yet another object of this invention is to provide a closure arrangement of the character described which is capable of being easily inventoried.

It is yet another object of this invention to provide a closure arrangement of the character described which allows stoppering of bottles by unskilled laborers.

It is still another object of this invention to provide a method of stoppering bottles with liquid, water-based, pressurized, carbonated contents which is both inexpensive and efficient.

Still another object of this invention is to provide an apparatus for closing bottles whose contents are liquid, water-based, pressurized and carbonated, which allows inexpensive, efficient stoppering of such bottles.

Other objects of the invention in part will be obvious and in part will be pointed out hereinafter.

2. Brief Description of the Invention

In keeping with these objectives, and others which will become apparent hereinafter, one feature of this invention resides, briefly stated, in a closure arrangement for stoppering bottles with pressurized, carbonated, water-based liquid contents which consists of a bottle having an elongated neck portion, a mouth portion, a body portion, two axially spaced annular flanges on the neck portion adjacent to the mouth portion, and a one-piece corking means for stoppering said bottle.

In accordance with another feature of this invention the corking means has an annular ring which is receivable between the annular flanges of the neck portion, a stoppering portion which is receivable within the mouth portion, an elongated flexible tether which is in a folded state prior to the corking of the bottle and which is capable of unfolding slightly as the bottle is corked and further unfolding as the bottle is opened, and a plurality of frangible bridges which connect the stoppering portion to the ring in order to hold the parts of the corking means in proper alignment with one another before assembly on the bottle neck so as to efficiently stopper the bottle.

Another feature of the present invention resides in forming the flexible elongated tether so that it does not extend beyond the external periphery of the annular ring. In this manner, wiring of the bottles, which is standard practice for bottles with pressurized contents, is facilitated as is also the storing of large numbers of stoppered bottles.

A further feature of the invention resides in the connection between the corking means and the bottle provided by the flexible tether in its unfolded condition which prevents possible injury from a cork forcefully propelled out of a bottle.

Still a further feature of this invention resides in an apparatus for stoppering bottles of the character described with a corking means of the character described. The stoppering apparatus has a means for holding the corking means in proper position and orientation above an opened bottle and a driving means for driving the stoppering portion into the mouth portion of the bottle and for concomitantly forcing the annular ring between the two annular flanges.

In this manner the bottle can be stoppered in an efficient and inexpensive manner.

The novel features which are considered characteristic of the invention are set forth in the appended claims.

The invention itself, however, both as to its construction and its method of operation, together with additional objects and advantages thereof, will be best understood from the following description of a specific embodiment when read in connection with the accompanying drawings.

BRIEF DESCRIPTION OF THE DRAWINGS

FIG. 1 is a perspective view of the corking means, one of the components of the present invention, said means being shown prior to assembly on the bottle;

FIG. 2 is a sectional view taken substantially along the line 2—2 of FIG. 1;

FIG. 3 is a sectional view taken substantially along the line 3—3 of FIG. 1;

FIG. 4 is a partially broken away front view of an apparatus for stoppering bottles in accordance with the present invention;

FIG. 5 is a perspective view of the corking means of the present invention after it is in place on the bottle of the present invention;

FIG. 6 is a sectional view taken substantially along the line 6—6 of FIG. 5;

FIG. 7 is a sectional view taken substantially along the line 7—7 of FIG. 5;

FIG. 8 is a sectional view taken substantially along the line 8—8 of FIG. 5; and FIG. 9 is a front view of the corking means and bottle of the present invention after the bottle has been uncorked.

DETAILED DESCRIPTION OF THE PREFERRED EMBODIMENTS

Referring now in detail to the drawings, the reference numeral 10 denotes the corking means of the present invention.

As best seen in FIGS. 4 and 9, the corking means 10 is used to stopper bottles 12 with pressurized, carbonated, water-based liquid contents. The bottles 12 are discussed in detail hereinafter but generally consist of a body portion (not pictured); an elongated neck portion 14 with two annular flanges 16, 18 thereon; and a mouth portion 20, the flanges being parallel to one another, close to one another and near the mouth portion.

The corking means 10 is a one-piece molded plastic unit constructed of elastomeric material. Preferably the corking means is constructed of a high density polyethylene, but any other appropriate elastomeric material may be used.

As best seen in FIGS. 1–3, the corking means includes an elongated stopper 22. The stopper 22 is capable of being inserted with frictional engagement into the mouth portion 20 of the bottle 12. The stopper 22 is generally cylindrical. As best seen in FIG. 9, in a preferred embodiment, the stopper portion has on it a plurality of integral concentric annular ribs 24. The ribs 24 increase the amount of friction between the stopper 22 and the mouth portion 20 thereby providing a tighter closure for the bottle 12. They also improve the seal effected by the stopper.

The corking means 10 also has an enlarged head portion 26 which is integral to the stopper 22. The head is provided with evenly spaced longitudinal wedges 28. The wedges 28 provide a user with a better grip on the head portion 26 at the time the corking means 10 is removed from the bottle 12.

The corking means 10 is further provided with an annular circumferential ring 30. The annular circumferential ring 30 is dimensioned and shaped for snug reception between the two annular flanges 16, 18 of the neck portion 14 of the bottle 12. The annular circumferential ring is positioned and spaced below the head portion 26 and is concentric with the stopper 22; it is parallel to the lower surface of the head portion and perpendicular to the longitudinal axis of the stopper.

The corking means 10 has a flexible, slender elongated tether 32. One end 34 of the tether 32 is integrally connected to the bottom of the head portion 26 and the other end 36 of the tether 32 is integrally connected to the top of the annular circumferential ring 30. The tether 32 is in a folded state before the corking means 10 is inserted in the bottle 12. In other words, the length of the folded tether 32 is substantially greater than the distance between ends 34 and 36. The tether 32 serves to join the head 26 to the ring 30. The reaches of the folded tether are disposed in the space between the head and the ring and are oriented circumferentially of the longitudinal axis of the stopper at a radius approximately to that of the ring.

Prior to insertion in the bottle, the corking means includes a plurality of frangible bridges 38 which connect the bottom of the head 26 to the top of the ring 30. The frangible bridges break when the annular ring 30 is forced between the two flanges 16, 18 as best shown in FIGS. 5, 6, 7, and 9.

The bottle 12 whose contents are pressurized and carbonated as mentioned heretofore has a mouth portion 20, a body portion (not depicted) and a neck portion 14 with two annular flanges 16 and 18 thereon.

The two annular flanges 16 and 18 are relatively axially proximate. Further, flanges 16 and 18 are circumferential and squat. The flanges 16 and 18 are spaced apart longitudinally of the neck portion 14 and lie adjacent to the mouth portion 20.

The bottle 12 may be made of any appropriate material. As the bottle will contain pressurized, carbonated contents, the bottle 12 must be constructed so that it can withstand the pressure of the contents. Further as the contents of the bottle will usually be champagne, the bottle in a preferred embodiment is made of a colored glass and is shaped and constructed to augment the feelings of celebration and wealth that people usually associate with champagne consumption.

The diameter of the upper annular neck flange 16 is slightly greater than the diameter of the lower annular neck flange 18. Further, the inner diameter of the annular ring 30 is slightly smaller than the outer diameter of the upper annular neck flange 16. In a preferred embodiment the outer diameter of the upper annular neck flange 16 is about one millimeter more than the outer diameter of the lower annular neck flange 18 and the inner diameter of the annular ring 30 is about 1.5 millimeters less than the outer diameter of the upper annular neck flange 16. The inner diameter of the annular ring 30 is slightly smaller than the outer diameter of the lower annular neck flange 16. In the preferred embodiment as above described, this respective dimensioning of the two annular neck flanges 16 and 18 and the annular ring 30 permits the annular ring 30 to be pushed down mechanically over the upper neck flange, expanding as it does so, and then constrict and come to rest between the two neck flanges 16 and 18 and further permits the annular ring 30 to be reversibly releaseable from its position between the two flanges 16 and 18 by manual pressure in a downward direction to expand over the lower neck flange. This is desirable to facilitate pouring of the bottle contents after removal of the stopper from the bottle 12.

The neck portion 14 of the bottle 12 is straight in shape for a few inches and then flares outwardly at a small angle. In a preferred embodiment the neck portion 14 is straight for approximately two to three inches below the mouth and then flares outwardly approximately 2°–3°.

The flexible tether 32 is approximately 1/16 of an inch to a side in square cross-section providing a proper amount of flexibility for said tether to perform all of the functions required of it.

As the corking means 10 is assembled with the bottle 12, various changes occur in some of its component parts.

As best seen in FIGS. 5, 6, 7, the frangible bridges 38 are broken when the corking means is assembled with the bottle. The frangible bridges will stretch and break when the annular ring 30 is forced down between the two annular flanges 16 and 18 inasmuch as the axial distance between the head and ring of the corking means as molded is less than the distance between these elements as mounted on the bottle. This leaves the flexible tether 32 as the sole connection between the annular ring 30 and the head portion 26.

As the corking means 10 is positioned on the bottle 12, the flexible tether 32 partially unfolds.

Due to the material and dimensions of said flexible tether 32 it is capable of the afore-mentioned partial unfolding during placement of the corking means 10 on the bottle 12.

Additionally, as best seen in FIG. 9, the flexible tether 32 is capable of additional unfolding when the corking means 10 is removed from the bottle 12 prior to pouring of the contents of the bottle. In this manner the flexible tether 32 continuously provides a means for joining together the head portion 26 and the annular ring 30. The flexible tether retains the corking means 10 attached to the bottle 12 when the bottle is open and thus prevents the injuries that might occur when the cork of the bottle with pressurized contents is propelled from such a bottle.

The flexible tether 32 in its unfolded condition is of sufficient length to allow the corking means 10 to be so placed in relationship to the bottle that the corking means 10 does not interfere with the decanting of the bottle contents.

In its folded and also in its partially unfolded condition, the flexible tether 32 extends circumferentially below the head 26 and does not extend beyond the external peripheries of said head 26 and said annular ring 30. This is particularly advantageous in that it prevents interference by the tether 32 with the wire 40 that is wrapped about the bottle 12 after the corking means is positioned therein.

Wrapping of bottles which contain champagne with wire 40 is a standard practice for both safety and aesthetic reasons. It is thus important that the corking means 10 contains no elements which would interfere with the placement of the wire 40 about the closed bottle.

The corking means 10 may, in addition to the parts heretofore described, contain at least one frangible connecting element (E) for connecting the flexible tether 32 to at least one other element of the corking means 10. In a preferred embodiment of the corking means has three such frangible connecting elements, connecting the tether 32 to the annular ring 30, the frangible bridges 38 and the head 26. Although all of the parts of the corking means will stay in proper alignment to each other without these frangible connecting elements, the frangible connecting elements provide, if desired, extra stability to the corking means 10 and further provide additional means to keep all other elements of said corking means in proper alignment to one another prior to assembly with the bottle.

As can be seen from FIG. 4, the present invention provides both a method of and apparatus for stoppering bottles 12 with pressurized, carbonated, water-based contents.

The bottle provided in the method of this invention, is the bottle 12, heretofore described. The corking means 10 heretofore described is also provided, as molded, for stoppering the bottle. In accordance with the method of the present invention, the stopper portion 22 of the corking means is inserted into the mouth portion 20 of the bottle 12, and the annular ring 30 is concomitantly forced downward until it engages the neck of the bottle between the two annular flanges 16, 18. The wire 40 when is wrapped around the corking means and the bottle. The wire contains a seal (not depicted) to indicate that the bottle has not been opened previously. As is standard in the bottling of champagne aand sparkling wines, the corked and wired bottle may be wrapped with a foil-type paper (not depicted).

The wire 40 used for wrapping the corked bottle is a thin soft steel wire which is standard in the art.

An apparatus 41 for stoppering the bottle 12 with the corking means 10 also is provided.

The apparatus includes a locating means 42 for holding the as-molded corking means 10 in proper position and orientation above an open bottle 12 with the stopper directed downwardly directly above the bottle mouth. The locating means may be any appropriate means for so holding the corking means in place. Appropriately it may include plates capable of moving outwardly away from the center of the corking means 10 to allow the corking means to be positioned in the bottle.

The apparatus 41 further includes a ram 44 for driving the stopper portion 22 into the mouth portion 20 of the bottle 12 and for concomitantly forcing the annular ring 30 between the two annular flanges 16, 18. In a preferred embodiment, there are two auxiliary driving means, namely a sleeve 46 and a plunger 48.

The plunger 48 is attached to the ram by a resilient lost motion means 50 which in a preferred embodiment is a compressible spring for yielding driving the stopper portion 22 into the mouth portion 20 of the bottle. The spring is used because after the stopper portion 22 is driven into the mouth 20 by the plunger 48, the sleeve 46 continues to move downwardly, forcing the annular ring 30 between and over the annular flange 16 to come to rest between the flanges 16, 18. The plunger 48 drives the stoppering portion 22 into the mouth portion 20 a split-second before the sleeve 46 forces the annular ring 30 between the flanges 16, 18. The frangible bridges 38 and elements E break as the sleeve forces the annular ring between the annular flanges 16, 18.

The sleeve 46 is dimensioned, shaped and guided to accurately drive the annular ring 30 into position, and the plunger 48 is dimensioned, shaped and guided for accurate driving of the stoppering portion 22 into the mouth portion 20.

As various possible embodiments might be made of the above invention, and as various changes might be made in the embodiment set forth, it is to be understood that all matters herein described and shown in the accompanying drawings are to be interpreted as illustrative and not in a limited sense.

I claim:

1. A method for stoppering a bottle with pressurized, carbonated, water-based liquid contents; said method comprising the steps of:

(a) providing a bottle having a body portion; an elongated neck portion; and, a mouth portion; said neck portion having two relatively axially proximate, circumferential, squat, annular flanges spaced apart longitudinally of the neck and adjacent to the mouth;

(b) providing a corking means having:

(i) an elongated, generally circularly cylindrical stopper, insertable with frictional engagement into the mouth portion of the bottle;

(ii) a head connected to the stopper;

(iii) an annular, circumferential ring, dimensioned and shaped for reception between the two annular flanges of the bottle neck; said annular ring being positioned and spaced below the head as molded and being concentric with the stopper, said ring being below the head;

(iv) a flexible, elongated tether having one end connected to the ring and the other end connected to the head; said tether being in a folded state as molded and having a length substantially greater than the distance between said one end and said other end; and (v) a plurality of short frangible bridges, circumferentially spaced apart of each other; said frangible bridges connecting the head to the ring;

(vi) the stopper, head, ring, tether and bridges being integrally molded in one piece of elastomeric plastic;

(c) inserting the stopper portion of the corking means into the mouth portion of the bottle with a die; and (d) thereafter forcing the annular ring portion of the corking means downwardly with a second die over the upper of the two annular flanges to a position between the two annular flanges of the bottle;

whereby the frangible bridges hold the stopper and annular ring in proper position with respect to one another for insertion and reception respectively in and around the bottle neck; said frangible bridges breaking when the annular ring is forced into place between the flanges.

2. A method of stoppering a bottle with pressurized, carbonated, water-based liquid contents, said method comprising the steps of:

(a) providing a bottle having a body portion, an elongated neck with a circumscribing integral flange and a mouth;

(b) providing a corking means of a molded one-piece elastomeric plastic construction having (i) an elongated generally circularly cylindrical stopper, insertable with frictional engagement into the mouth of the bottle, and (ii) a head connected to the stopper, (iii) a ring positioned and spaced below the head as molded and being concentric with the stopper, said ring having an internal diameter slightly smaller than the external diameter of the flange, (iv) a flexible elongated tether having means for attaching a first portion of the tether to the ring below the mouth and means for attaching a second portion of the tether to the corking means, (v) a plurality of short frangible bridges integrally molded in one piece with the head and the ring, said bridges being circumferentially spaced from one another, (c) inserting the stopper into the mouth of the bottle, (d) the length of the intermediate portion of the tether between the first portion and the second portion being substantially greater than the distance between the points of attachment of the attaching means to the corking means and the bottle, and (e) thereafter forcing the ring downwardly over the annular flange, said ring expanding as it passes over the flange and constricting after it has passed over the flange, said bridges being broken when the ring is forced over the flange to free the ring from the stopper except for the connection therebetween effected by the folded tether while the stopper remains in the bottle, (f) a substantial part of the length of the intermediate portion being in folded condition and being maintained in that condition close to the bottle when assembled thereon whereby when the corking means is withdrawn from the bottle and starts to move rapidly away therefrom under the pressure of gas accumulated in the bottle, its flight from the bottle will be restrained to a short distance.

* * * * *